US012145045B2

(12) United States Patent
Brasch et al.

(10) Patent No.: US 12,145,045 B2
(45) Date of Patent: Nov. 19, 2024

(54) WALL MOUNTED DUMBBELL AND KETTLEBELL STORAGE SHELF

(71) Applicant: PRx Performance, LLC, Fargo, ND (US)

(72) Inventors: Brian B. Brasch, Fargo, ND (US); Alexander M. Johnson, Fargo, ND (US); Spencer R. Sweeney, Fargo, ND (US); Garrett A. Iverson, Fargo, ND (US)

(73) Assignee: PRx Performance, LLC, Fargo, ND (US)

( * ) Notice: Subject to any disclaimer, the term of this patent is extended or adjusted under 35 U.S.C. 154(b) by 56 days.

(21) Appl. No.: 18/179,724

(22) Filed: Mar. 7, 2023

(65) Prior Publication Data

US 2023/0321513 A1 Oct. 12, 2023

Related U.S. Application Data

(60) Provisional application No. 63/328,377, filed on Apr. 7, 2022.

(51) Int. Cl.
*A63B 71/00* (2006.01)
*A47B 57/04* (2006.01)
*A63B 21/072* (2006.01)

(52) U.S. Cl.
CPC ..... *A63B 71/0036* (2013.01); *A47B 57/045* (2013.01); *A63B 21/072* (2013.01)

(58) Field of Classification Search
CPC ..... A63B 71/0036; A63B 21/072; A63B 2225/09; A47B 57/045
See application file for complete search history.

(56) References Cited

U.S. PATENT DOCUMENTS 1,345,344 A * 7/1920 Blandford ..... A47B 57/045 248/242
3,085,693 A * 4/1963 Shell ..... A47B 57/425 248/248

(Continued)

FOREIGN PATENT DOCUMENTS

DE 9401919 U1 * 4/1994
FR 1304947 A * 9/1962

(Continued)

OTHER PUBLICATIONS https://www.hooked-sports.com/shop/multi-purpose-storage-shelf-v2/; Hooked Sports Multi Purpose Storage Shelf v2 Product Webpage; Received Jan. 25, 2023, Printed Apr. 13, 2023.

(Continued)

*Primary Examiner* — Stanton L Krycinski
(74) *Attorney, Agent, or Firm* — Neustel Law Offices

(57) ABSTRACT

A shelf assembly may include a shelf top configured to support one or more stored articles (e.g. dumbbells, kettlebells, etc.), and at least one shelf bracket configured to be coupled to the shelf top and to a wall to securely position the shelf top relative to the wall. In some embodiments, the shelf bracket may be coupled to the wall in different ways so that in a first use position, the shelf top extends horizontally relative to the wall, and in a second use position, the shelf top is positioned in a downwardly sloped position relative to the wall. In further embodiments, the shelf bracket may be adjustable to enable the shelf top to be positioned over a range of desired positions.

17 Claims, 6 Drawing Sheets

(56) References Cited

U.S. PATENT DOCUMENTS

| | | | | | |
|---|---|---|---|---|---|
| 3,485,382 | A * | 12/1969 | Larson | A47F 5/0815 | 248/220.42 |
| 3,921,539 | A * | 11/1975 | Berger | A47F 5/12 | 108/106 |
| 4,008,873 | A * | 2/1977 | Travaglio | A47B 57/045 | 211/186 |
| 4,603,781 | A * | 8/1986 | Ryan, Jr. | A47F 5/01 | 211/90.04 |
| 4,730,738 | A * | 3/1988 | Bartus | A47B 57/045 | 248/242 |
| 4,753,405 | A * | 6/1988 | Camilleri | A47B 96/061 | 108/134 |
| 5,253,837 | A * | 10/1993 | Loux | A47G 25/0692 | 211/90.01 |
| 5,351,842 | A * | 10/1994 | Remmers | A47F 5/08 | 108/29 |
| 5,580,018 | A * | 12/1996 | Remmers | A47B 55/02 | 211/90.01 |
| 5,706,737 | A * | 1/1998 | Whitehead | A47B 96/02 | 108/42 |
| D393,961 | S * | 5/1998 | Whitehead | D6/552 | |
| 6,220,463 | B1 * | 4/2001 | Pullen | A47B 57/045 | 211/186 |
| 6,257,425 | B1 * | 7/2001 | Liu | A47K 10/04 | 211/90.01 |
| 6,581,788 | B1 * | 6/2003 | Winig | F16B 12/26 | 211/183 |
| D491,449 | S * | 6/2004 | Winig | D8/381 | |
| D494,457 | S * | 8/2004 | Winig | D8/381 | |
| D495,594 | S * | 9/2004 | Gibson | D8/381 | |
| 6,913,235 | B2 * | 7/2005 | Oberhaus | A47B 96/028 | 248/249 |
| D509,393 | S * | 9/2005 | Winig | D6/574 | |
| 7,150,364 | B2 * | 12/2006 | Jablow | A47B 45/00 | 211/175 |
| 7,353,957 | B2 * | 4/2008 | Winig | A47F 5/0815 | 211/59.1 |
| 8,500,078 | B2 * | 8/2013 | Castellanos | A47B 96/06 | 248/223.41 |
| 8,720,704 | B2 * | 5/2014 | Gupta | A47B 96/025 | 211/74 |
| 10,207,172 | B2 * | 2/2019 | Hillson | A63B 21/06 | |
| 10,477,960 | B1 * | 11/2019 | Johnson | A47B 5/02 | |
| 10,814,205 | B2 * | 10/2020 | Vester | A63B 71/0036 | |
| 10,926,151 | B2 * | 2/2021 | Dunahay | A63B 23/1218 | |
| 11,583,110 | B2 * | 2/2023 | Smedley | A47F 5/103 | |
| 2019/0269992 | A1 | 9/2019 | Dunahay | | |

FOREIGN PATENT DOCUMENTS

| | | | |
|---|---|---|---|
| FR | 1331199 | A * | 6/1963 |
| FR | 1407578 | A * | 7/1965 |
| GB | 164544 | A * | 6/1921 |
| GB | 865101 | A * | 4/1961 |
| GB | 929114 | A * | 6/1963 |

OTHER PUBLICATIONS https://www.hooked-sports.com/shop/multi-purpose-storage-shelf/; Hooked Sports Multi Purpose Storage Shelf Product Webpage; Received Jan. 25, 2023, Printed Apr. 13, 2023.

https://www.roguefitness.com/rogue-universal-storage-system-2-0; Rogue Fitness Universal Storage System 2.0 Product Webpage; Received Jan. 25, 2023, Printed Apr. 13, 2023.

https://www.hooked-sports.com/shop/dumbbell-rack-2-pcs/; Hooked Sports Dumbbell Rack 2 pcs Product Webpage; Received Jan. 25, 2023, Printed Apr. 13, 2023.

https://www.roguefitness.com/monster-single-post-storage-shelf; Rogue Fitness Monster Single Post Storage Shelf Product Webpage; Received Jan. 25, 2023, Printed Apr. 13, 2023.

https://www.sorinex.com/products/iron-bear-kettlebell-wing; Sorinex Exercise Equipment Iron Bear Kettlebell Wing Product Webpage; Received Jan. 25, 2023, Printed Apr. 13, 2023.

https://straydogstrength.com/product/flat-storage-trays/; Straydog Strength Flat Storage Trays Product Webpage; Received Jan. 25, 2023, Printed Apr. 13, 2023.

https://straydogstrength.com/product/dumbbell-trays/; Straydog Strength Dumbbell Trays Product Webpage; Received Jan. 25, 2023, Printed Apr. 13, 2023.

https://www.sorinex.com/products/iron-bear-storage; Sorinex Exercise Equipment Iron Bear Multistorage Unit Product Webpage; Received Jan. 25, 2023, Printed Apr. 13, 2023.

https://www.titan.fitness/strength/dumbbells/dumbbell-storage/3-tier-dumbbell-weight-rack/400192.html; Titan Fitness 3 Tier Dumbbell Weight Rack Product Webpage; Received Jan. 25, 2023, Printed Apr. 13, 2023.

https://repfitness.com/products/dumbbell-storage-rack; REP Fitness Dumbbell Rack Product Webpage; Received Jan. 25, 2023, Printed Apr. 13, 2023.

https://www.roguefitness.com/rogue-powerblock-cart; Rogue Powerblock Cart Product Webpage; Received Jan. 25, 2023, Printed Apr. 13, 2023.

https://www.walmart.com/ip/Hyper-Tough-6-in-x-15-3-4-in-Modern-Black-Laminated-Wood-Shelf-Kit/106415073?; Hyper Tough 6 in.×15¾ in. Modern Black Laminated Wood Shelf Kit Walmart Product Webpage; Received Jan. 25, 2023, Printed Apr. 13, 2023.

https://www.webstaurantstore.com/regency-42-wall-mounted-slanted-rack-shelf/600WR42.html; Webstaurant Store Regency 42" Wall Mounted Slanted Rack Shelf Product Page; Received Jan. 25, 2023, Printed Apr. 13, 2023.

https://www.sorinex.com/products/storage-cart; Sorinex Exercise Equipment Storage Cart Product Webpage; Received Jan. 25, 2023, Printed Apr. 13, 2023.

https://www.sorinex.com/products/bumper-wing-storage-with-shelf; Sorinex Exercise Equipment Bumper Wing Storage with Shelf Product Webpage; Received Jan. 25, 2023, Printed Apr. 13, 2023.

* cited by examiner

WALL MOUNTED DUMBBELL AND KETTLEBELL STORAGE SHELF

CROSS REFERENCE TO RELATED APPLICATIONS

I hereby claim benefit under Title 35, United States Code, Section 119(e) of U.S. provisional patent application Ser. No. 63/328,377 filed Apr. 7, 2022. The 63/328,377 application is hereby incorporated by reference in its entirety into this application.

FIELD OF THE INVENTION

The present disclosure relates generally to wall shelf assemblies for storing heavy devices, and more specifically, to wall-mounted storage shelf assemblies for holding heavy fitness equipment such as dumbbells, kettlebells and the like.

STATEMENT REGARDING FEDERALLY SPONSORED RESEARCH OR DEVELOPMENT

Not applicable to this application.

BACKGROUND

Some exercise equipment, such as dumbbells, kettlebells, and other such weight-lifting equipment, can be quite heavy. For example, such devices are typically used in matching pairs, and it is usually desirable to have numerous pairs of dumbbells in order to provide suitable workout opportunities for a wide range of different people and different exercise intensities. Accordingly, a well-equipped exercise facility may have a relatively large set of dumbbells. Such sets of dumbbells (or kettlebells) may conventionally be stored on a storage rack that is positioned on a suitable floor surface. Although desirable results have been achieved using such conventional storage racks, there is room for improvement.

SUMMARY

Some of the various embodiments of the present disclosure relate to wall storage shelf assemblies for storing heavy devices, and more specifically, to wall-mounted storage shelf assemblies for storing dumbbells, kettlebells, and other similar heavy fitness equipment. Embodiments of shelf assemblies in accordance with the present disclosure may advantageously require less floor space for storage of such equipment, and may improve convenience and satisfaction of the user, in comparison with prior art storage devices.

Accordingly, in some embodiments, a shelf assembly comprises a shelf top having a holding member configured to support one or more stored articles (e.g. dumbbells), and at least one shelf bracket configured to be coupled to the shelf top and to a wall to securely position the shelf top relative to the wall. In some embodiments, the shelf bracket includes a first side and a second side, the first and second sides being elongated and coupled at first ends thereof to form an approximately right angle, and a third side that is elongated and coupled between the first and second sides at second ends thereof and positioned opposite from the approximately right angle to form a generally triangular shape. In some embodiments, the at least one shelf bracket is further configured such that in a first use position, the first side is positionable to extend approximately vertically along the wall with the first end of the first side at an upper position, the first side being couplable to the wall with the second side projecting outwardly from the wall and being couplable to the shelf top to support the holding member in an approximately horizontal position relative to the wall. In addition, in a second use position, the first side is positionable to extend approximately vertically along the wall with the first end of the first side at a lower position, the first side being couplable to the wall, the second side projecting outwardly from the wall, the third side sloping downwardly and away from the second end of the first side, the third side being couplable to the shelf top to support the holding member in a sloped position relative to the wall.

Alternately, in some embodiments, a shelf assembly includes a shelf top having a holding member including a surface configured to support one or more stored articles (e.g. dumbbells), and a retaining rim projecting upwardly from a portion of a perimeter of the holding member to at least partially retain the one or more stored articles on the holding member. The shelf assembly also includes a pair of shelf brackets, each shelf bracket being configured to be coupled to the shelf top at opposing lateral ends thereof, each shelf bracket having a mounting portion configured to be attached to a wall, and a support portion coupled to the mounting portion and extending outwardly from the wall, the support portion being couplable to the retaining rim of the shelf top to suspend the shelf top between the pair of shelf brackets and to securely position the shelf top relative to the wall. In some embodiments, the support portion of each shelf bracket includes an adjustable support arm, the adjustable support arm having an adjustable length such that in a first use position, the adjustable support arm is moveable to a first length to support the holding member in an approximately horizontal position relative to the wall, and in a second use position, the adjustable support arm is moveable to a second length to support the holding member in a sloped position relative to the wall.

There has thus been outlined, rather broadly, some of the embodiments of the present disclosure in order that the detailed description thereof may be better understood, and in order that the present contribution to the art may be better appreciated. There are additional embodiments that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

As noted above, a well-equipped exercise facility may have a relatively large set of dumbbells (or kettlebells), and such dumbbells may conventionally be stored on a storage rack that is positioned on a suitable floor surface. In some environments, however, floor space may be extremely limited, particularly in shared use environments wherein floor space may be needed at certain times for certain functions or actions (e.g. for parking a car in a garage), and may be available at other times for exercising and related activities. Therefore, it may not always be desirable for a rack holding a set of dumbbells to permanently occupy floor space that must sometimes be used for other purposes.

Generally, in at least some embodiments, a shelf assembly in accordance with the present disclosure may include a shelf top configured to support one or more stored articles (e.g. dumbbells, kettlebells, etc.), and at least one shelf bracket configured to be coupled to the shelf top and to a wall to securely position the shelf top relative to the wall. In some embodiments, the shelf bracket may be coupled to the wall in different ways so that in a first use position, the shelf top extends horizontally relative to the wall, and in a second use position, the shelf top is positioned in a downwardly sloped position relative to the wall. In other embodiments, the shelf bracket may be adjustable to enable the shelf top to be positioned over a range of desired positions, as described more fully below.

Figure 1:
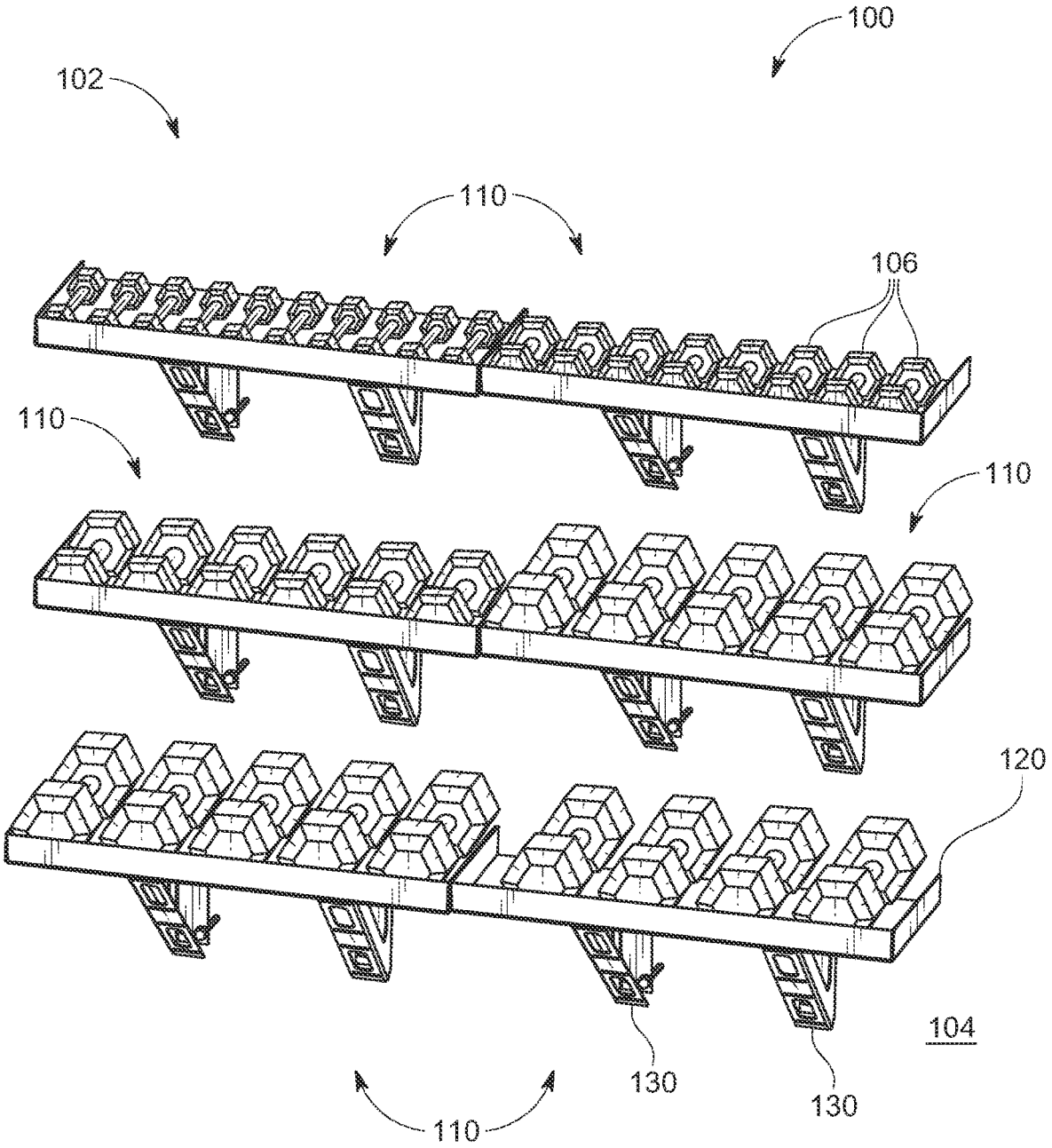
FIG. 1 is a perspective view of a plurality of shelf assemblies in a first use position in accordance with an example embodiment.

FIG. 1 is a perspective view of a plurality of shelf assemblies 100 in a first use position 102 in accordance with an example embodiment. In this embodiment, each shelf assembly 110 includes a shelf top 120 coupled to and supported by a pair of shelf brackets 130 that are attached to a wall 104 or other suitable upright surface. In the first use position 102, the shelf brackets 130 are attached to the wall 104 such that, when the shelf top 120 is attached to the shelf brackets 130, the shelf top 120 projects outwardly from the wall 104 at an approximately right angle (i.e. approximately 90 degrees) such that, assuming the wall 104 is approximately vertical, the shelf top 120 provides an approximately horizontal (or flat) storage surface. For illustrative purposes in FIG. 1, a plurality of dumbbells 106 are positioned on each of the shelf tops 120, however, it will be appreciated that the shelf assemblies 110 may be used to store other types of equipment (e.g. kettlebells, etc.).

Figure 2:
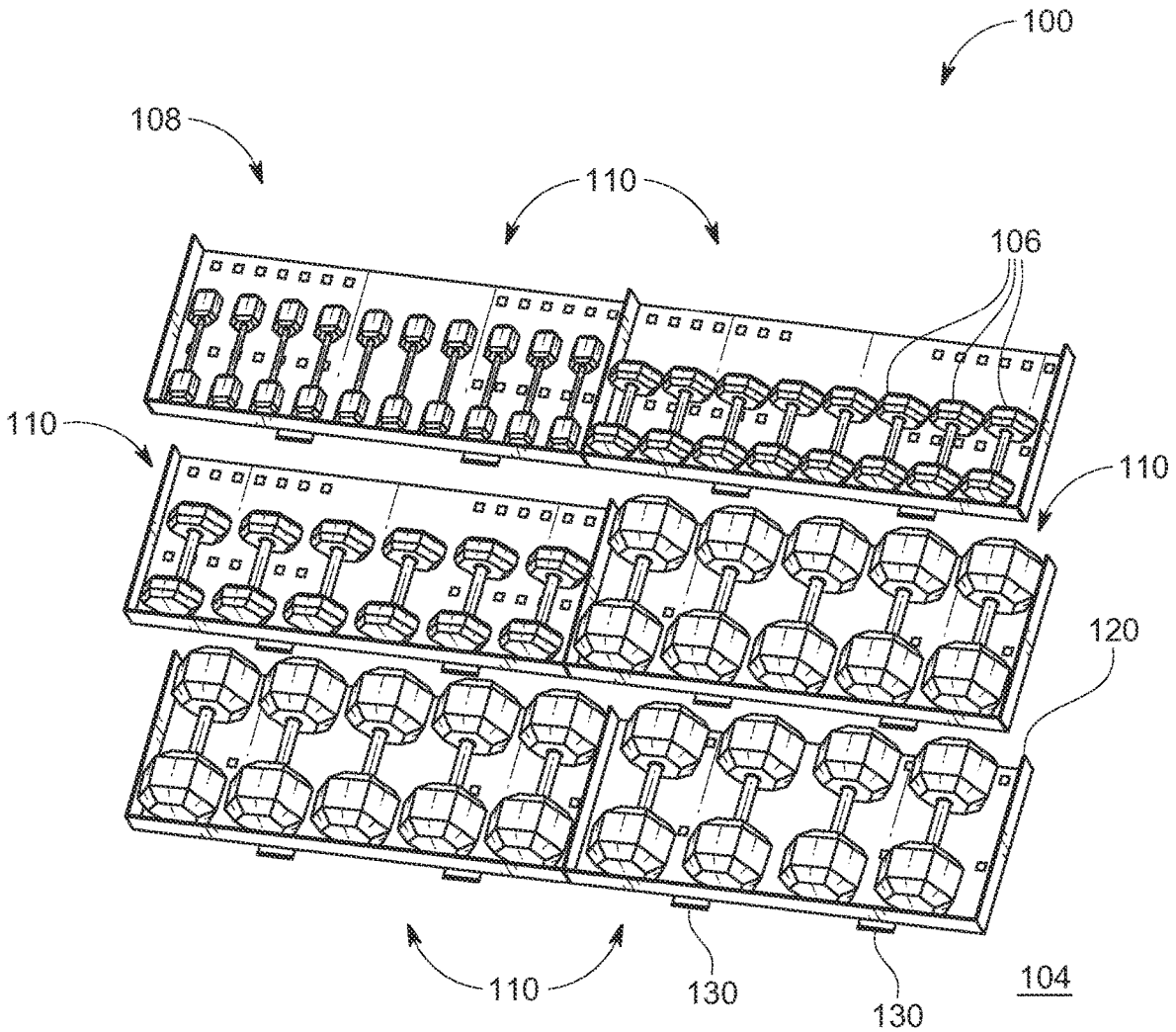
FIG. 2 is a perspective view of the plurality of shelf assemblies in a second use position in accordance with another example embodiment.

FIG. 2 is a perspective view of the plurality of shelf assemblies 100 in a second use position 108 in accordance with an example embodiment. In the second use position 108, the shelf brackets 130 may be attached to the wall 104 in a different orientation such that the top shelf 120 projects downwardly from the wall 104 at an angle, providing a sloping or angled storage configuration. The dumbbells 106 are shown positioned on each shelf assembly 110 in FIG. 2 for illustrative purposes. Accordingly, it will be appreciated that in at least some embodiments, the shelf assembly 110 may be used in either the first use position 102 (FIG. 1) or the second use position 108 (FIG. 2), as described more fully below.

Embodiments of shelf assemblies in accordance with the present disclosure may advantageously provide a wall-mounted shelf assembly that eliminates the need for a free-standing rack or shelf that occupies valuable floor space. In addition, embodiments of shelf assemblies in accordance with the present disclosure may provide a wall mounted shelf that mounts easily and conveniently, and in a modular fashion both horizontally and vertically, and may provide multiple positions (horizontal or sloped) as desired by the user, as described more fully below.

B. Shelf Assembly

The shelf assembly 110 of FIGS. 1-2 will now be described in greater detail to provide an improved understanding of embodiments in accordance with the present disclosure. It will be appreciated that shelf assemblies in accordance with the present disclosure may have several different embodiments or configurations, and is not necessarily limited to the particular embodiment shown in the accompanying figures.

Figure 3:
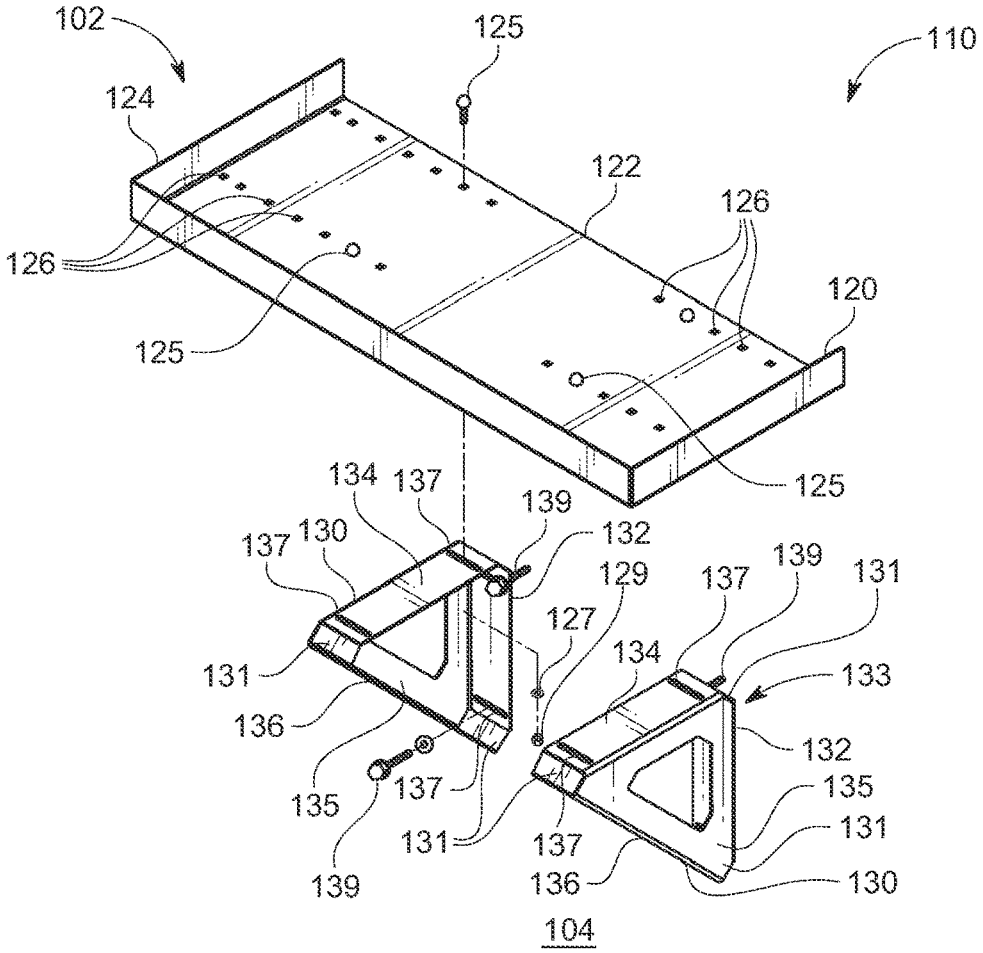
FIG. 3 is an exploded view of the shelf assembly of FIG. 1 in accordance with an example embodiment.

More specifically, FIG. 3 is an exploded view of the shelf assembly 110 of FIG. 1 having the top shelf 120 and the pair of shelf brackets 130 in the first use position 102. In some embodiments, the top shelf 120 includes a holding member 124 that provides a storage surface upon which the dumbbells 104 may be placed, and a retaining rim 124 that projects upwards from the holding member 122. In the embodiment shown in FIG. 3, the holding member 122 is a flat, rectangular member, and the retaining rim 124 projects upwardly from the perimeter of the holding member 122 on three of the four sides of the rectangular holding member 122. In at least some embodiments, the retaining rim 124 may be configured to inhibit or prevent articles stored on the holding member 122 (e.g. dumbbell 106) from unintentionally rolling or sliding off the holding member 122. In some embodiments, the retaining rim 124 may be formed by bending edge portions of the holding member 122 upwardly.

As further shown in FIG. 3, in some embodiments, a plurality of fastening holes 126 are formed in the holding member 122, and one or more fastening members 125 (e.g. bolts) may be engaged through a corresponding one or more of the fastening holes 126 to attach the shelf top 120 to each of the shelf brackets 130. For example, in some embodiments, the fastening members 125 may be configured as bolts that are engaged through the fastening hole 126, and then through a washer 127 and a fastening nut 129. In some embodiments, the holding member 122 of the shelf top 120 may be formed of a 12 gauge steel material, and the fastening holes 126 may be 0.34 inch square holes, however, it will be appreciated that other materials, material thicknesses, hole sizes, and hole shapes (e.g. round, oval, etc.) may be employed. Similarly, in some embodiments, the fastening members 125 may be 5/16 inch diameter by 3/4 inch long carriage bolts, and the fastening nuts 129 may be 5/16 inch nylock nuts, however, it will be appreciated that other sizes and types of fasteners may be employed.

Figure 4:
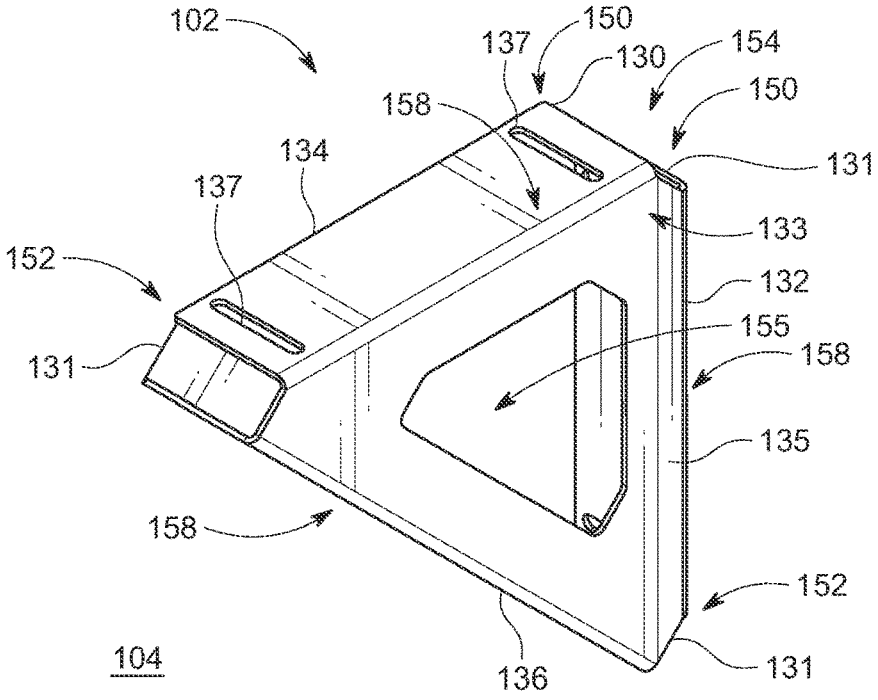
FIG. 4 is an enlarged perspective view of a shelf bracket of the shelf assembly of FIG. 3 in accordance with an example embodiment.

FIG. 4 is an enlarged perspective view of the shelf bracket 130 of the shelf assembly 110 of FIG. 3. In some embodiments, each shelf bracket 130 may be configured as a generally triangular member having a first side 132, a second side 134, and a third side 136. In the embodiment shown in FIGS. 3-4, the sides 132, 134, 136 are connected together by end members 131, such that the three tips of the generally triangular shape of the shelf bracket 130 are relatively blunted. In at least some alternate embodiments, however, the end members 131 may be eliminated, and the ends of the sides 132, 134, 136 may be coupled directed to each other.

In at least some embodiments, the first side 132 and the second side 134 of the shelf bracket 130 are coupled together to form a right angle 133 (i.e. approximately 90 degree angle) therebetween, while the third side 136 (or hypotenuse) is situated opposite from the right angle 133. In some embodiments, each of the other angles of the generally triangular shelf bracket 130 may be approximately equal (e.g. two 45 degree angles), however, in alternate embodiments, the other angles may be any suitable angular value (e.g. 50°/40°, 60°/30°, etc.). In some embodiments, a web member 135 is coupled to the three sides 132, 134, 136 (and to the end members 131) along lateral edges 158 thereof to provide additional strength and rigidity to the shelf bracket 130. In some embodiments, the web member 135 may be an approximately triangular shaped web member 135 having an aperture 155 therethrough.

In some embodiments, one or more coupling slots 137 are formed in each of the first, second, and third sides 132, 134, 136 of the shelf bracket 130. More specifically, as shown in FIGS. 3-4, in some embodiments, two coupling slots 137 are formed in each of the first, second, and third sides 132, 134, 136 of the shelf bracket 130, wherein each coupling slot 137 is positioned proximate to opposing ends of the sides 132, 134, 136. Each coupling slot 137 extends laterally across the corresponding side 132, 134, 136 such that when the shelf bracket 130 is mounted to the wall 104, the coupling slot 137 is approximately parallel with the wall 104. One or more mounting members 139 (e.g. screws, lag bolts, etc.) may be engaged through a corresponding one or more of the coupling slots 137 to attach the shelf bracket 130 to the wall 104. In some embodiments, the sides 132, 134, 136 of the shelf bracket 130 may be formed of a 12 gauge steel material, and the coupling slots 137 may be approximately 0.34 inch wide by 2 inch long slots, however, it will be appreciated that other materials, material thicknesses, and slot sizes may be employed. Similarly, in some embodiments, the mounting members 139 may be 5/16 inch diameter by 2.5 inch lag bolts, however, it will be appreciated that other sizes and types of mounting members may be employed.

In the first use position 102 (FIGS. 1 and 3-4), the first side 132 of the shelf bracket 130 is positioned against the wall 104 in an approximately vertical orientation, with the right angle 133 at an upper end of the first side 132, the second side 134 extending away from the wall 104 as an uppermost portion of the shelf bracket 130, and the third side 136 extending downwardly toward the wall 104. In other words, in the first use position 102, the third side 136 (or hypotenuse) is facing downwardly toward a floor surface. Mounting members 139 are engaged through the coupling slots 137 disposed in the first side 132 and engaged securely with the wall 104. Because the coupling slots 137 extend laterally across the first side 132, the position of the mounting members 139 may be adjusted laterally as needed to engage the wall 104 over a range of suitable positions (e.g. to engage with suitable structural members in the wall 104). In some embodiments, two shelf brackets 130 are attached to the wall 104 in a spaced apart orientation to support the shelf top 120, however, it will be appreciated that in alternate embodiments, a greater number (e.g. 3, 4, etc.) or fewer number (e.g. 1) of shelf brackets 130 may be used.

In addition, in the first use position 102, the second side 134 is of each shelf bracket 130 extends outwardly from the wall 104 in an approximately horizontal configuration (assuming the wall 104 is approximately vertical). The shelf top 120 may be positioned on the second sides 134 of the shelf brackets 130, and secured to the shelf brackets 130 by engaging fastening members 125 through the fastening holes 126 of the shelf top 120, through the coupling slots 137 of the second sides 134, and into engagement with washers 127 and fastening nuts 129. Because the coupling slots 137 extend laterally across the second side 134, the coupling slots 137 allow for the position of the shelf top 120 to be laterally adjusted as needed to accommodate the positions of the fastening members 125 as they extend through the fastening holes 126 over a range of suitable positions. For example, in some embodiments, the shelf brackets 130 may be laterally spaced apart by as little as 8 inches apart or as far as 38 inches apart, however, in other embodiments, greater and lesser spacings are possible. The shelf top 120 is thereby securely fastened to the wall 104 so that the holding member 122 extends outwardly from the wall 104 in an approximately horizontal position for storing the dumbbells 106 or other desired equipment.

Figure 5:
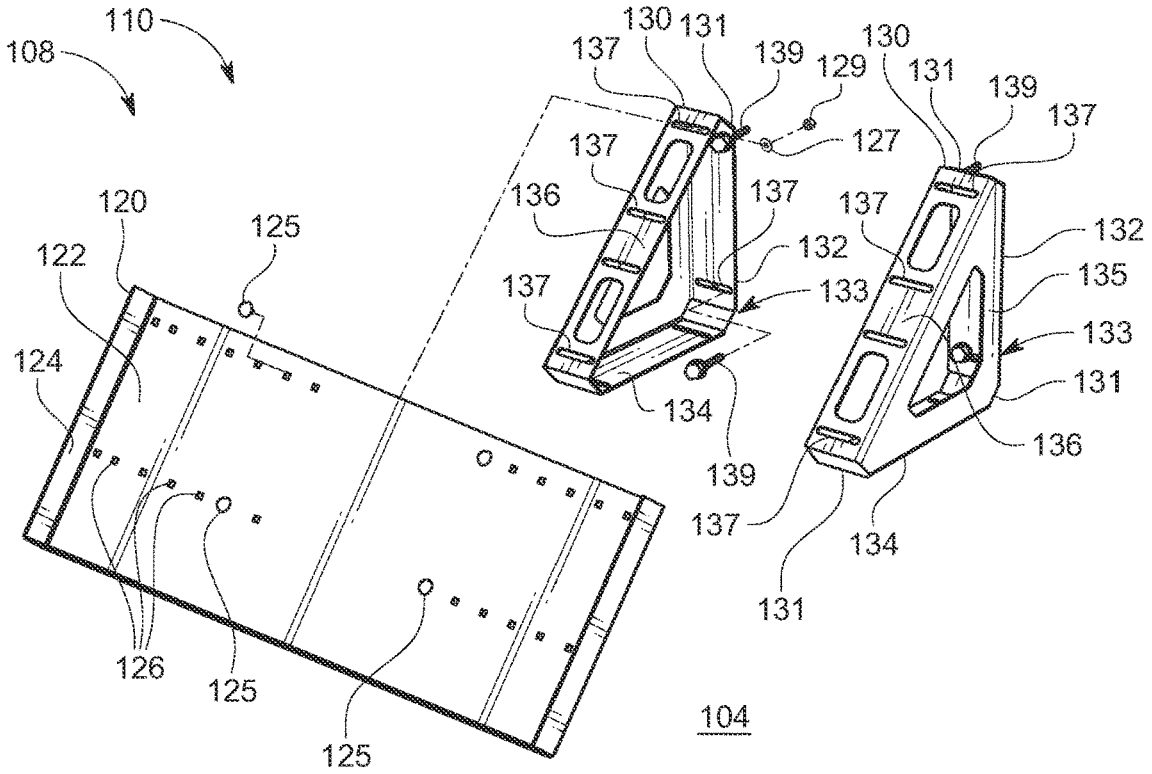
FIG. 5 is an exploded view of the shelf assembly of FIG. 2 in accordance with another example embodiment.
Figure 6:
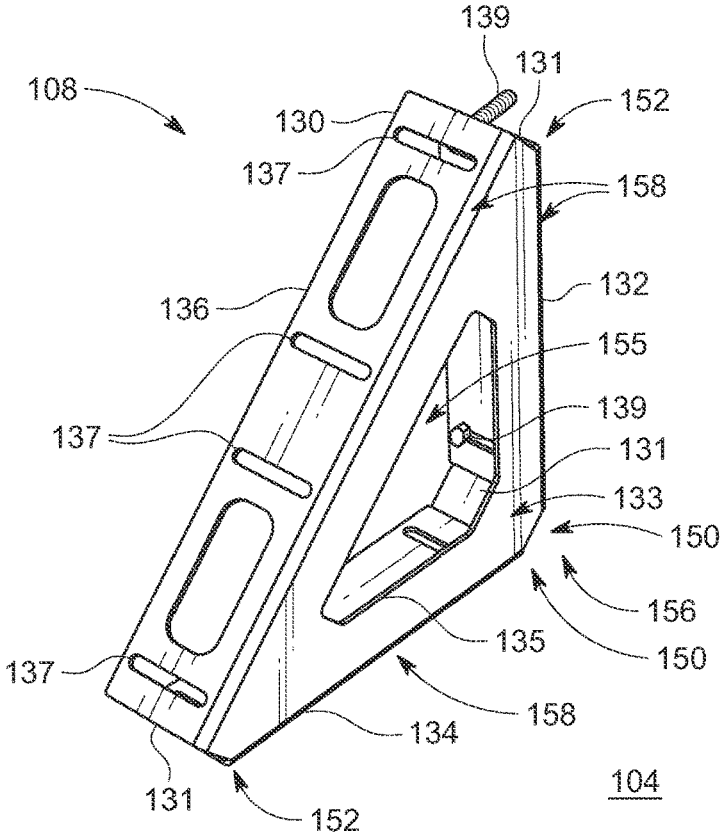
FIG. 6 is an enlarged perspective view of the shelf bracket of the shelf assembly of FIG. 5 in accordance with an example embodiment.

FIG. 5 is an exploded view of the shelf assembly 110 of FIG. 2 having the top shelf 120 and the pair of shelf brackets 130 in the second use position 108. FIG. 6 is an enlarged perspective view of the shelf bracket 130 of the shelf assembly 110 of FIG. 5. It will be appreciated that, using the same components of the shelf assembly 110 as described above with respect to FIGS. 3-4, the shelf assembly 110 may be re-configured and attached to the wall 104 differently so that the shelf assembly 110 may now be positioned in the second use position 108.

In the second use position 108 (FIGS. 5-6), the first side 132 of each shelf bracket 130 is positioned against the wall 104 in an approximately vertical orientation, with the right angle 133 at a lower end of the first side 132, the second side 134 extending away from the wall 104 as a lowermost portion of the shelf bracket 130, and the third side 136 extending from the upper end of the first side 132 downwardly in a sloping manner away from the wall 104. In other words, in the second use position 108, the third side 136 (or hypotenuse) is facing upwardly away from the floor surface at an angle. Thus, in comparison with the position of the shelf brackets 130 in the first use position 102, the shelf brackets 130 in the second use position 108 are inverted, and may also be switched from one side to the other to maintain the web member 135 on the outwardly lateral side of the shelf bracket 130 and the shelf assembly 110.

As further shown in FIG. 5-6, the shelf brackets 130 are securely attached to the wall 104 by mounting members 139 engaged through the coupling slots 137 disposed in the first side 132 and engaged securely with the wall 104. Similarly, the shelf top 120 is attached to the downwardly sloping third sides 136 of the shelf brackets 130 by engaging fastening members 125 through the fastening holes 126 of the shelf top 120, through the coupling slots 137 of the third sides 136, and into engagement with washers 127 and fastening nuts 129

Thus, in the second use position 10 (FIGS. 5-6), the holding member 122 of the shelf top 120 slopes downwardly and away from the wall 104, providing a suitable sloped or angled storage area for storing the dumbbells 106 or other desired equipment. The retaining rim 124 that extends upwardly around a portion of the perimeter of the holding member 122 may prevent the dumbbells 106 from sliding downwardly off of the holding member 122. In the embodiment shown in FIG. 5-6, the holding member 122 of the shelf top 120 is held by the shelf brackets 130 at a slope angle of approximately 45 degrees, however, in alternate embodiments, greater or lesser slope angles may be achieved (e.g. by adjusting the lengths of the sides 132, 134, 136).

Accordingly, in some embodiments, a shelf assembly 110 comprises a shelf top 120 having a holding member 122 configured to support one or more stored articles (e.g. dumbbells 106), and at least one shelf bracket 130 configured to be coupled to the shelf top 120 and to a wall 104 to securely position the shelf top 120 relative to the wall 104. In some embodiments, the shelf bracket 130 includes a first side 132 and a second side 134, the first and second sides 132, 134 being elongated and coupled at first ends 150 thereof (e.g. by an end member 131, as shown in FIGS. 3-6) to form an approximately right angle 133, and a third side 136 that is elongated and coupled between the first and second sides at second ends 152 thereof (e.g. by an end member 131, as shown in FIGS. 3-6) and positioned opposite from the approximately right angle 133 to form a generally triangular shape. In some embodiments, the at least one shelf bracket 130 is further configured such that in a first use position 102, the first side 132 is positionable to extend approximately vertically along the wall 104 with the first end 150 of the first side 132 at an upper position 154, the first side 132 being couplable to the wall 104 with the second side 134 projecting outwardly from the wall 104 and being couplable to the shelf top 120 to support the holding member 122 in an approximately horizontal position relative to the wall 104, and in a second use position 108, the first side 132 is positionable to extend approximately vertically along the wall 104 with the first end 150 of the first side 132 at a lower position 156, the first side 132 being couplable to the wall 104, the second side 134 projecting outwardly from the wall 104, the third side 136 sloping downwardly and away from the second end 152 of the first side 132, the third side 136 being couplable to the shelf top 120 to support the holding member 122 in a sloped position relative to the wall 104. In some embodiments, the first and second sides 132, 134 are coupled at first ends 150 thereof by an end member 131.

In addition, in some embodiments, the at least one shelf bracket 130 comprises a web member 135 coupled to the first side 132, the second side 134, and the third side 136 along lateral edges 158 of the first, second, and third sides 132, 134, 136 (FIGS. 3-6). In some embodiments, the web member 135 comprises an approximately triangular shaped web member 135 having an aperture 155 therethrough.

As best shown in FIGS. 3-6, in some embodiments, the first side 132 of the shelf bracket 130 may have a plurality of coupling slots 137 formed therein, each coupling slot 137 extending laterally across the first side 132 and being configured to receive one or more mounting members 139 therethrough to enable the first side 132 to be secured to the wall 104. Similarly, in some embodiments, the second side 134 of the shelf bracket 130 may have a plurality of coupling slots 137 formed therein, each coupling slot 137 extending laterally across the second side 134 and being configured to receive one or more coupling members 125 therethrough to enable the second side 134 to be secured to the shelf top 120 in the first use position 102. And in some embodiments, the third side 136 of the shelf bracket 130 may have a plurality of coupling slots 137 formed therein, each coupling slot 137 extending laterally across the third side 136 and being configured to receive one or more coupling members 125 therethrough to enable the third side 136 to be secured to the shelf top 120 in the second use position 108.

In some embodiments, the holding member 122 of the shelf top 120 comprises a rectangular flat surface, and a retaining rim 124 projects upwardly from a portion of a perimeter of the holding member 122. In further embodiments, the holding member 122 may have a plurality of coupling holes 126 formed therethrough, each coupling hole 126 configured to receive a coupling member 125 therethrough for coupling the shelf top 120 to the shelf bracket 130. In some embodiments, in the second use position 108, the holding member 122 is supported in the sloped position at an approximately 45 degree angle relative to the wall 104. In further embodiments, in the second use position 108, the holding member 122 is supported in the sloped position at an angle relative to the wall 104, wherein the angle may be any desirable value over a range of possible values (e.g. between 30 to 60 degrees) depending upon the relative lengths of the first and second sides 132, 134 of the shelf bracket 130.

It will be appreciated that once the shelf assembly 110 is installed is installed in either the first use position 102 or the second use position 108, users can interact with it by placing and removing objects or items that they wish to store on the shelf assembly 110 when the items are not in use. Embodiments of shelf assemblies in accordance with the present disclosure may be capable of holding very heavy items and may be easily mounted to walls.

Embodiments of shelf assemblies in accordance with the present disclosure may provide considerable advantages over conventional shelf assemblies. For example, in environments wherein floor space may be extremely limited, particularly in shared use environments wherein floor space may be needed at certain times for certain functions or actions (e.g. for parking a car in a garage), embodiments in accordance with the present disclosure may advantageously provide a wall-mounted shelf assembly, thereby eliminating the need for a free standing rack or shelf that occupies valuable floor space. Embodiments in accordance with the present disclosure may provide a wall mounted dumbbell and kettlebell storage shelf for holding heavy fitness equipment, and mount to the wall easily to be convenient and space-saving. In addition, embodiments of shelf assemblies as disclosed herein may advantageously mount to the wall in a modular fashion both horizontally and vertically, and may be mounted to the wall with the shelf top in at least two fixed positions (horizontal or sloped) as desired by the user.

C. Alternate Embodiments of Shelf Assemblies

It will be appreciated that shelf assemblies in accordance with the present disclosure may have several different embodiments, and that the present disclosure is not necessarily limited to the particular embodiments described above with respect to FIGS. 1-6. A few alternate embodiments of shelf assemblies in accordance with the present disclosure will now be described, however, this discussion of alternate embodiments is not intended to be an exhaustive list of all possible embodiments of shelf assemblies that are within the teachings of the present disclosure. For the sake of brevity, not all details and aspects of each alternate embodiment will be described in detail, but rather, only some of the aspects that may be different from previously described embodiments will be discussed.

Figure 7:
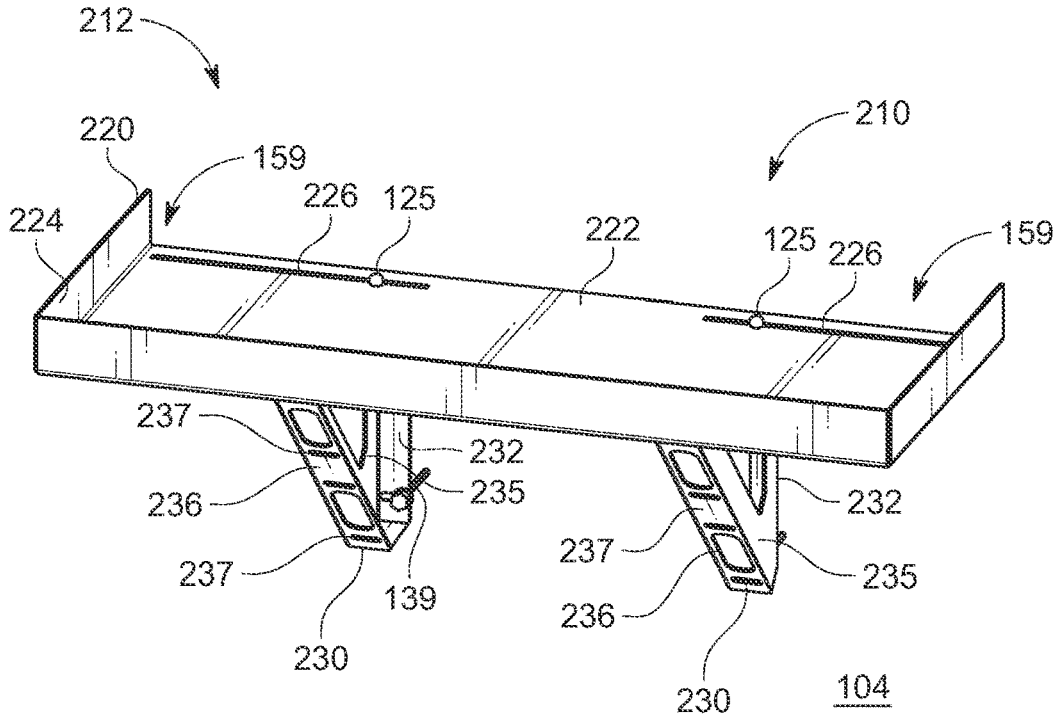
FIG. 7 is a perspective view of a shelf assembly in accordance with an alternate embodiment.

FIG. 7 is a perspective view of a shelf assembly 210 in accordance with an alternate embodiment. In this embodiment, the shelf assembly 210 includes a pair of shelf brackets 230 attached to a wall 104, and a shelf top 220 coupled to the shelf brackets 230 in a first use position 202. As described above with respect to FIG. 3, the shelf brackets 230 are generally triangular brackets having a first side 232 coupled to the wall 104 and a second side 234 (not visible in FIG. 7) extending approximately horizontally outwardly from the wall 104 to support the shelf top 220 in the first use position 202. The first and second sides 232, 234 form a right angle 235 (not visible) therebetween, and a third side 236 spans between the ends of the first and second sides 232, 234 opposite from the right angle 235. The first, second, and third sides 232, 234, 236 have a plurality of coupling slots 237 formed therein, as described above with respect to FIGS. 3-6, and a web member 235 extends at least partially between the first, second, and third sides 232, 234, 236 to provide rigidity and strength to each shelf bracket 230.

As further shown in FIG. 7, the top shelf 220 includes a holding member 222 having a relatively flat surface for supporting equipment, and a retaining rim 224 extending upwardly around a portion of a perimeter of the holding member 222. In this embodiment, however, a plurality of fastening slots 226 are formed in the holding member 222. In some embodiments, there may be four (or more) fastening slots 226 formed in the holding member 222 of the shelf top 220 (two visible in FIG. 7). During assembly, the fastening members 125 are engaged through the fastening slots 226, and through corresponding coupling slots 237 formed in the second sides 234 of the shelf brackets 230 to secure the shelf top 220 onto the horizontally extending second sides 234 of the shelf brackets 230.

Because the shelf top 220 has fastening slots 226 though the holding member 222 (instead of fastening holes 126), the shelf top 220 may be more readily adjusted laterally (left and right) on the shelf brackets 230 into a wide variety of suitable mounting positions. In addition, it may be appreciated that the shelf brackets 230 shown in FIG. 7 are substantially similar to the shelf brackets 130 described above, except that the shelf brackets 230 are made from smaller, thinner stock, providing a more lightweight shelf bracket 230 in comparison with the shelf bracket 130 (FIGS. 1-6) described above.

Accordingly, in some other embodiments, the holding member 122 may have a plurality of coupling slots 226 formed therethrough, each coupling slot 266 configured to receive a coupling member 125 therethrough for coupling the shelf top 120 to the shelf bracket 130. In some embodiments, the shelf top 120 is coupled to at least two shelf brackets 130, with the at least two shelf brackets 130 being laterally spaced apart and positioned proximate opposing lateral ends 159 (FIG. 7) of the shelf top 120.

Figure 8:
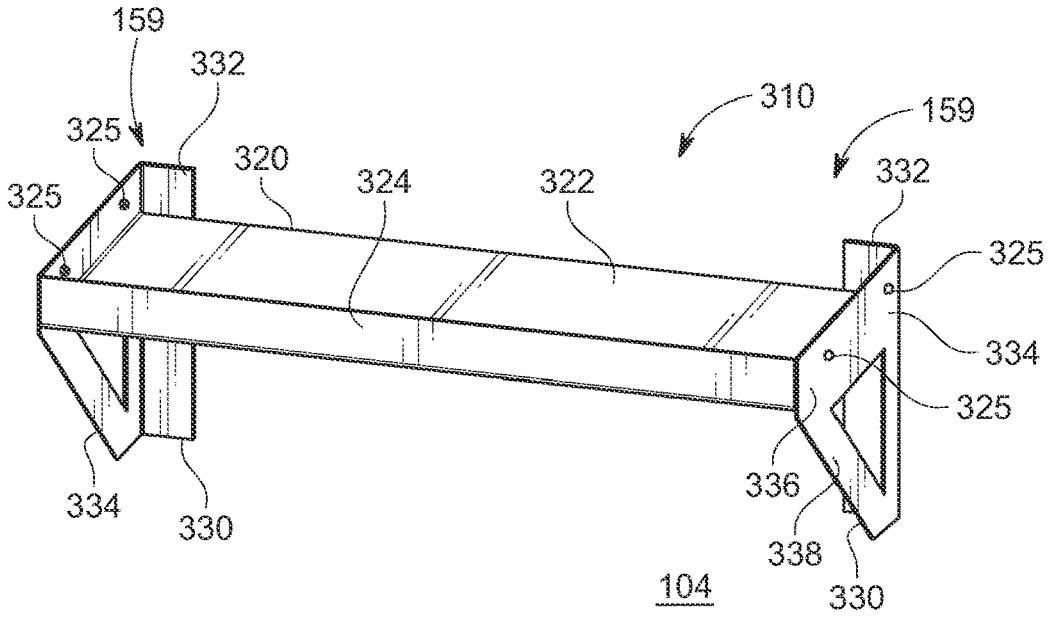
FIG. 8 is a perspective view of a shelf assembly in accordance with another alternate embodiment.

FIG. 8 is a perspective view of a shelf assembly 310 in accordance with another alternate embodiment. In this embodiment, the shelf assembly 310 includes a pair of shelf brackets 330 attached to a wall 104, and a shelf top 320 coupled to the shelf brackets 330. Unlike the previously described embodiments, however, the shelf top 320 does not rest atop the shelf brackets 330, but rather, is suspended between the shelf brackets 330 which are coupled at opposing ends of the shelf top 320, as described more fully below.

As shown in FIG. 8, in some embodiments, each of the shelf brackets 330 includes a mounting plate 332 that engages against the wall 104, and a support plate 334 that is coupled to the mounting plate 332 and projects approximately perpendicularly outwardly from the wall 104. In the embodiment shown in FIG. 8, the support plate 334 includes a coupling portion 336 that is coupled to the shelf top 320, and a support portion 338 that mechanically supports the coupling portion 336. In some embodiments, the coupling portion 336 may be a generally rectangular portion, and the support portion 338 may be a generally triangular portion, however, it will be appreciated that other configurations of the support plate 334 may be readily conceived.

As further shown in FIG. 8, the shelf top 320 includes a holding member 322 having a relatively flat surface for supporting equipment, and a retaining rim 324 extending upwardly around a portion of a perimeter of the holding member 322. In some embodiments, the retaining rim 324 of the shelf top 320 is coupled to the support portion 336 of the support plate 334 of the shelf brackets 330 by a plurality of fasteners 325 (e.g. bolts and nuts, two of each shown), suspending the shelf top 320 between the shelf brackets 330 such that the holding member 322 extends approximately horizontally outwardly from the wall 104.

As shown in FIG. 8, in some embodiments, the support portion 334 of each shelf bracket 330 comprises a coupling portion 336 couplable to the retaining rim 324 and a support portion 338 depending downwardly from the coupling portion 336. In some embodiments, each shelf bracket 330 is formed of a unitary piece of material and the mounting portion 332 is bent at an approximately right angle to the support portion 334.

It will be appreciated that the relatively simple configuration of the shelf brackets 330 (FIG. 8) may provide considerable advantages in cost and ease of manufacturing. For example, in some embodiments, the shelf brackets 330 may be cut (or stamped) from a single sheet of suitable material (e.g. sheet metal steel) in a single unitary piece that includes both the mounting plate 332 and the support plate 334 in a preliminary co-planar orientation, which may then be bent such that the mounting plate 332 and the support plate 334 are oriented at a right angle to form the shelf bracket 330 shown in FIG. 8. Because the shelf brackets 330 have a relatively simple construction, the shelf brackets 330 may advantageously provide the desired wall mounted shelf assembly 310 in a relatively cheaper configuration in comparison with other shelf brackets that require more complicated assembly processes (e.g. shelf brackets 130 of FIGS. 1-6, shelf brackets 230 of FIG. 7).

Figure 9:
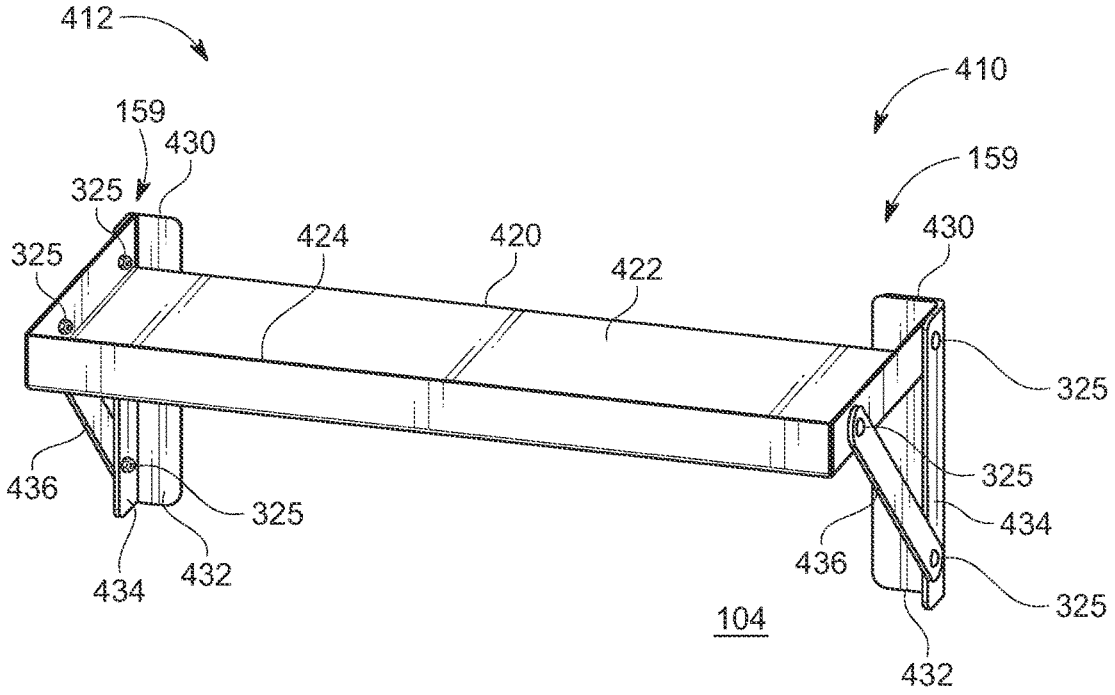
FIG. 9 is a perspective view of a shelf assembly in a first use position in accordance with another alternate embodiment.

FIG. 9 is a perspective view of a shelf assembly 410 in a first use position 412 in accordance with another alternate embodiment. In this embodiment, the shelf assembly 410 includes a pair of shelf brackets 430 attached to a wall 104, and a shelf top 420 suspended between the shelf brackets 430. More specifically, each of the shelf brackets 430 includes a mounting plate 432 that engages against the wall 104, and a support plate 434 that is coupled to the mounting plate 432 and projects approximately perpendicularly outwardly from the wall 104. As shown in FIG. 9, in some embodiments, the mounting plate 432 comprises a generally rectangular plate, and similarly, the support plate 434 comprises a generally rectangular plate. The shelf bracket 430 further includes an adjustable support arm 436 that extends upwardly from a lower end of the support plate 434 and is coupled to the shelf top 420, mechanically supporting the shelf top 420 in adjustable gusseted configuration.

As further shown in FIG. 9, the shelf top 420 includes a holding member 422 having a relatively flat surface for supporting equipment, and a retaining rim 424 extending upwardly around a portion of a perimeter of the holding member 422. In some embodiments, the retaining rim 424 of the shelf top 420 is coupled to the support plate 436 of the shelf brackets 430 by one or more fasteners 325 (e.g. bolts and nuts), and is also coupled to a distal end of each adjustable support arm 436 by one or more fasteners 325. The shelf top 420 is thereby suspending between the shelf brackets 430 such that the holding member 422 extends approximately horizontally outwardly from the wall 104 in the first use position 412.

Figure 10:
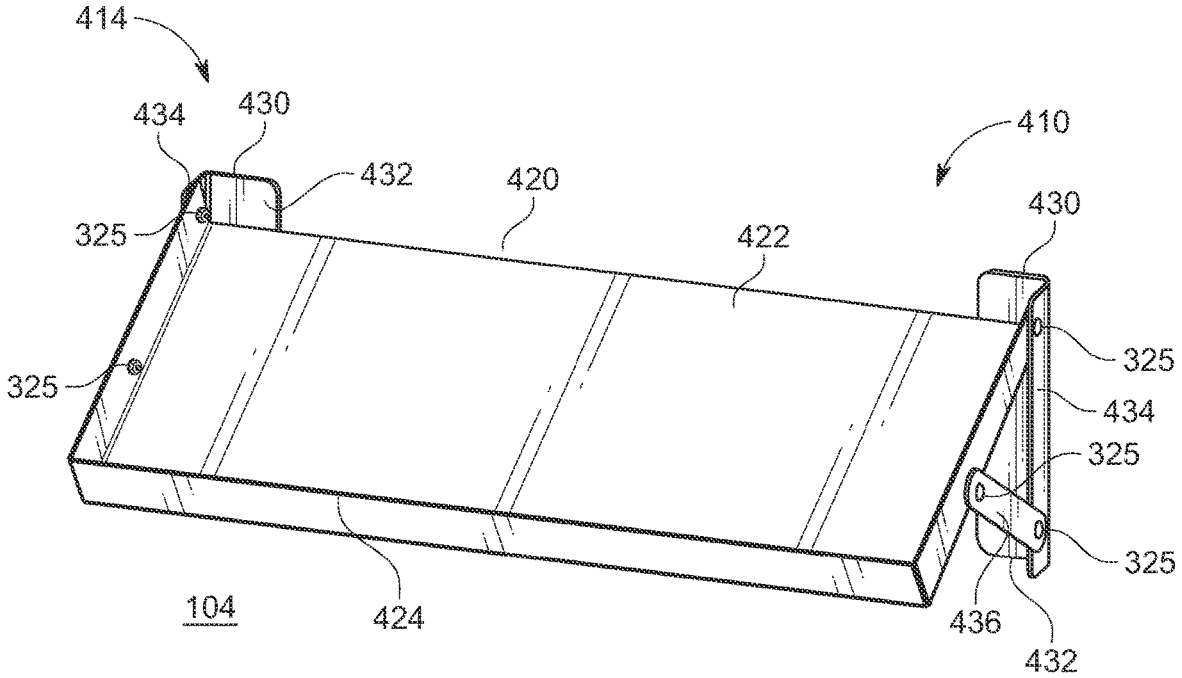
FIG. 10 is a perspective view of the shelf assembly of FIG. 9 in a second use position in accordance with another alternate embodiment.

FIG. 10 is a perspective view of the shelf assembly 410 of FIG. 9 in a second use position 414. More specifically, in some embodiments, the adjustable support arm 436 is adjusted to be shorter so that holding member 422 of the shelf top 420 slopes downwardly away from the wall 104. More specifically, the adjustable support arm 436 extends upwardly from a lower end of the support plate 434 and is coupled to the retaining rim 424 of the shelf top 420, mechanically supporting the shelf top 420 in a gusseted configuration. Because the adjustable support arm 436 is shortened in comparison to the first use position 412 (FIG. 9), the shelf top 420 is supported in the second use position 414 (FIG. 10).

In the second use position 414 (FIG. 10), the shelf top 420 is sloped or angled downwardly relative to the horizontal so that the holding member 422 provides a sloped storage surface for storing the dumbbells 106 or other suitable equipment. In at least some embodiments, the retaining rim 424 may be configured to inhibit or prevent articles stored on the holding member 422 (e.g. dumbbell 106) from unintentionally rolling or sliding off the holding member 422 of the shelf top 420. In some embodiments, the slope of the holding member 422 of the shelf top 420 may be controlled by suitable selection of a length of the adjustable support arm 436 to provide a desired slope angle. For example, in some embodiments, the slope of the holding member 422 may be within a range of 30° to 60° with respect to horizontal (horizontal being zero degrees), however, it will be appreciated that other slope angles are possible and readily achievable.

The adjustable support arm 436 may have a variety of known configurations that enable the length of the adjustable support arm 436 to be controllably adjusted. For example, in some embodiments, the adjustable support arm 436 may include two slide members (e.g. links, tubes, channel members, etc.) that are slidably engaged and that may be held in a desired position by a locking member, such as a set screw, a spring pin, or other suitable locking arrangement. A user may disengage the locking member, adjust the position of the slide members to shorten or lengthen the adjustable support arm 436, then re-engage the locking member to hold the adjustable support arm 436 in a desired length or configuration.

Accordingly, in some embodiments, a shelf assembly 310, 410 may include a shelf top 320, 420 having a holding member 322, 422 including a surface configured to support one or more stored articles (e.g. dumbbells 106), and a retaining rim 324, 424 projecting upwardly from a portion of a perimeter of the holding member 322, 422 to at least partially retain the one or more stored articles 106 on the holding member 322, 422; and a pair of shelf brackets 330, 430, each shelf bracket 330, 430 being configured to be coupled to the shelf top 320, 420 at opposing lateral ends 159 thereof, each shelf bracket 330, 430 having a mounting portion 332, 432 configured to be attached to a wall 104, and a support portion 334, 434 coupled to the mounting portion 332, 432 and extending outwardly from the wall 104, the support portion 334, 434 being couplable to the retaining rim 324, 424 of the shelf top 320, 420 to suspend the shelf top 320, 420 between the pair of shelf brackets 330, 430 and to securely position the shelf top 320, 420 relative to the wall 104.

More specifically, in some embodiments, the support portion 434 of each shelf bracket 430 includes an adjustable support arm 436, the adjustable support arm 436 having an adjustable length such that in a first use position 412, the adjustable support arm 436 is moveable to a first length to support the holding member 422 in an approximately horizontal position relative to the wall 104, and in a second use position 414, the adjustable support arm 436 is moveable to a second length to support the holding member 422 in a sloped position relative to the wall 104.

As noted above, embodiments of shelf assemblies in accordance with the present disclosure may provide considerable advantages over conventional shelf assemblies. Such embodiments may advantageously provide a wall-mounted shelf assembly, thereby eliminating the need for a free-standing rack or shelf that occupies valuable floor space. Embodiments in accordance with the present disclosure may provide a wall mounted shelf that mounts easily and conveniently, and in a modular fashion both horizontally and vertically, and may provide multiple positions (horizontal or sloped) as desired by the user.

Other advantages may become apparent through use of embodiments in accordance with the present disclosure. It will be appreciated that embodiments in accordance with the present disclosure may be embodied in the form illustrated in the accompanying drawings, attention being called to the fact, however, that the drawings are illustrative only, and that changes may be made in the specific construction illustrated and described, and that such alternate embodiments remain within the scope of this application.

While various embodiments have been described above, it should be understood that they have been presented by way of example only, and not limitation. The descriptions are not intended to limit the scope of the technology to the particular forms set forth herein. To the contrary, the present descriptions are intended to cover such alternatives, modifications, and equivalents as may be included within the spirit and scope of the technology as defined by the appended claims and otherwise appreciated by one of ordinary skill in the art. The various embodiments of the present disclosure may be embodied in other specific forms without departing from the spirit or essential attributes thereof, and it is therefore desired that the various embodiments in the present disclosure be considered in all respects as illustrative and not restrictive. Thus, the breadth and scope of a preferred embodiment should not be limited by any of the above-described exemplary embodiments.

Unless otherwise defined, all technical and scientific terms used herein have the same meaning as commonly understood by one of ordinary skill in the art to which this invention belongs. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. Any headings utilized within the description are for convenience only and have no legal or limiting effect.

What is claimed is:

1. A shelf assembly, comprising:

a shelf top having a holding member configured to support one or more stored articles; and at least one shelf bracket configured to be coupled to the shelf top and to a wall to securely position the shelf top relative to the wall, the at least one shelf bracket having a first side and a second side, the first and second sides being elongated and coupled at first ends thereof to form an approximately right angle, and a third side that is elongated and coupled between the first and second sides at second ends thereof and positioned opposite from the approximately right angle to form a generally triangular shape, wherein the at least one shelf bracket is further configured such that in a first use position, the first side is positionable to extend approximately vertically along the wall with the first end of the first side at an upper position, the first side being couplable to the wall with the second side projecting outwardly from the wall and being couplable to the shelf top to support the holding member in an approximately horizontal position relative to the wall; and in a second use position, the first side is positionable to extend approximately vertically along the wall with the first end of the first side at a lower position, the first side being couplable to the wall, the second side projecting outwardly from the wall, the third side sloping downwardly and away from the second end of the first side, the third side being couplable to the shelf top to support the holding member in a sloped position relative to the wall;

wherein the first side has a first elongate axis, wherein the first side has a first coupling slot formed in the first end of the first side, wherein the first coupling slot has an elongate axis that is perpendicular to the first elongate axis and wherein the first coupling slot of the first side accommodates more than one mounting member therethrough, and wherein the first side has a second coupling slot formed in the second end of the first side, wherein the second coupling slot of the first side has an elongate axis that is perpendicular to the first elongate axis and wherein the second coupling slot of the first side accommodates more than one mounting member therethrough; and wherein the second side has a second elongate axis, wherein the second side has a first coupling slot formed in the first end of the second side, wherein the first coupling slot of the second side has an elongate axis that is perpendicular to the second elongate axis and wherein the first coupling slot of the second side accommodates more than one coupling member therethrough, and wherein the second side has a second coupling slot formed in the second end of the second side, wherein the second coupling slot of the second side has an elongate axis that is perpendicular to the second elongate axis and wherein the second coupling slot accommodates more than one coupling member therethrough.

2. The shelf assembly of claim 1, wherein the at least one shelf bracket comprises a web member coupled to the first side, the second side, and the third side along lateral edges of the first, second, and third sides.

3. The shelf assembly of claim 1, wherein the third side is defined by an elongate axis and has a plurality of coupling slots formed therein, each coupling slot extending laterally across the third side in an orientation that is perpendicular to the elongate axis of the third side and accommodates more than one coupling member therethrough to enable the third side to be secured to the shelf top in the second use position.

4. The shelf assembly of claim 1, wherein the first and second sides are coupled at first ends thereof by an end member.

5. The shelf assembly of claim 1, wherein the holding member comprises a rectangular flat surface, and wherein the shelf top further comprises a retaining rim projecting upwardly from a portion of a perimeter of the holding member.

6. The shelf assembly of claim 1, wherein the holding member has a plurality of coupling holes formed therethrough and wherein each coupling hole of the holding member is configured to receive one of the more than one coupling members therethrough for coupling the shelf top to the at least one shelf bracket via the first coupling slot of the first side of the at least one shelf bracket or via the second coupling slot of the second side of the at least one second shelf bracket.

7. The shelf assembly of claim 1, wherein the at least one shelf bracket comprises at least two shelf brackets, and wherein the holding member has a plurality of coupling slots formed therethrough, each coupling slot configured to receive a coupling member therethrough for coupling the shelf top to the at least two shelf brackets with the at least two shelf brackets being laterally spaced apart and positioned proximate opposing lateral ends of the shelf top.

8. The shelf assembly of claim 1, wherein in the second use position, the holding member is supported in the sloped position at an approximately 45 degree angle relative to the wall.

9. A shelf assembly, comprising:

a shelf top having a holding member including a surface configured to support one or more stored articles, and a retaining rim projecting upwardly from a portion of a perimeter of the holding member to at least partially retain the one or more stored articles on the holding member; and a pair of shelf brackets, each shelf bracket being configured to be coupled to the shelf top at spaced apart locations, and configured to be attached to a wall to securely position the shelf top relative to the wall, each shelf bracket having a first side and a second side, the first and second sides being elongated and coupled at first ends thereof by a first end member, the first and second sides forming an approximately right angle therebetween, and a third side that is elongated and coupled between the first and second sides at second ends thereof by second and third end members, the third side being positioned opposite from the approximately right angle to form a generally triangular shape, each shelf bracket further including a web member coupled to the first side, the second side, and the third side along lateral edges of the first, second, and third sides, wherein each shelf bracket is further configured such that in a first use position, the first side is positionable to extend approximately vertically along the wall with the first end of the first side at an upper position, the first side being couplable to the wall with the second side projecting outwardly from the wall, the second side being couplable to the shelf top to support the holding member in an approximately horizontal position relative to the wall; and in a second use position, the first side is positionable to extend approximately vertically along the wall with the first end of the first side at a lower position, the first side being couplable to the wall with the second side projecting outwardly from the wall, the third side sloping downwardly and away from the second end of the first side, the third side being couplable to the shelf top to support the holding member in a sloped position relative to the wall;

wherein the first side has a first elongate axis, wherein the first side has a first coupling slot formed in the first end of the first side, wherein the first coupling slot has an elongate axis that is perpendicular to the first elongate axis and wherein the first coupling slot of the first side accommodates more than one mounting member therethrough, and wherein the first side has a second coupling slot formed in the second end of the first side, wherein the second coupling slot of the first side has an elongate axis that is perpendicular to the first elongate axis and wherein the second coupling slot of the first side accommodates more than one mounting member therethrough; and wherein the second side has a second elongate axis, wherein the second side has a first coupling slot formed in the first end of the second side, wherein the first coupling slot of the second side has an elongate axis that is perpendicular to the second elongate axis and wherein the first coupling slot of the second side accommodates more than one coupling member therethrough, and wherein the second side has a second coupling slot formed in the second end of the second side, wherein the second coupling slot of the second side has an elongate axis that is perpendicular to the second elongate axis and wherein the second coupling slot accommodates more than one coupling member therethrough.

10. The shelf assembly of claim 9, wherein the third side is defined by a third elongate axis and has a plurality of coupling slots formed therein, each coupling slot extending laterally across the third side in an orientation that is perpendicular to the third elongate axis of the third side and accommodates more than one coupling member therethrough.

11. The shelf assembly of claim 9, wherein the web member comprises an approximately triangular shaped web member having an aperture therethrough.

12. The shelf assembly of claim 9, wherein the surface configured to support one or more stored articles comprises a rectangular flat surface, and wherein the retaining rim projects upwardly from three sides of the rectangular flat surface.

13. The shelf assembly of claim 9, wherein the holding member has a plurality of coupling slots formed therethrough and wherein each coupling slot of the holding member is configured to receive one of the more than one coupling members therethrough for coupling the shelf top to at least one of the pair of shelf brackets via the first coupling slot of the first side of the at least one of the pair of shelf brackets or via the second coupling slot of the second side of the at least one of the pair of shelf brackets.

14. The shelf assembly of claim 9, wherein in the second use position, the holding member is supported in the sloped position at an angle relative to the wall, the angle being within a range of 30 to 60 degrees.

15. The shelf assembly of claim 1, wherein each coupling slot in the first side and the second side is defined by an upper edge that is parallel to a lower edge.

16. The shelf assembly of claim 3, wherein at least one of the first side, the second side, and the third side includes greater than two coupling slots.

17. The shelf assembly of claim 16, wherein the greater than two coupling slots are positioned within a middle portion of the at least one first side, second side, and third side, and wherein the greater than two coupling slots are perpendicular to the respective first elongate axis, second elongate axis, and third elongate axis.

* * * * *